US010184417B2

(12) United States Patent
Carboni et al.

(10) Patent No.: US 10,184,417 B2
(45) Date of Patent: Jan. 22, 2019

(54) FUEL INJECTION SYSTEM OF AN INTERNAL COMBUSTION ENGINE

(71) Applicant: GM GLOBAL TECHNOLOGY OPERATIONS LLC, Detroit, MI (US)

(72) Inventors: Daniele Carboni, Piemonte (IT); Ricardo Rossi, Castelnuovo di Garfagnana (LU) (IT)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 14/940,276

(22) Filed: Nov. 13, 2015

(65) Prior Publication Data

US 2016/0138514 A1 May 19, 2016

(30) Foreign Application Priority Data

Nov. 13, 2014 (GB) ..... 1420184.2

(51) Int. Cl.
*F02M 63/00* (2006.01)
*F02D 41/38* (2006.01)
(Continued)

(52) U.S. Cl.
CPC ..... *F02D 41/3863* (2013.01); *F02D 41/123* (2013.01); *F02M 37/0052* (2013.01);
(Continued)

(58) Field of Classification Search
CPC ..... F02M 63/0225; F02M 37/0052; F02M 63/02; F02M 26/22; F02D 41/3863; F02D 41/123; F02D 2200/0602; F02D 2200/0614; F02D 2200/101; F02B 29/04; F02B 37/00; F02B 37/18
(Continued)

(56) References Cited

U.S. PATENT DOCUMENTS 6,715,468 B2 * 4/2004 Uchiyama ..... F02D 41/221 123/339.15
6,748,923 B2 * 6/2004 Grossner ..... F02M 37/0029 123/446
(Continued)

OTHER PUBLICATIONS

Great Britain Patent Office, Great Britain Search Report for Great Britain Application No. 1420184.2, dated Apr. 29, 2015.

*Primary Examiner* — Hai Huynh
*Assistant Examiner* — Gonzalo Laguarda
(74) *Attorney, Agent, or Firm* — Lorenz & Kopf, LLP

(57) ABSTRACT

In a fuel injection system a high-pressure fuel pump is arranged to deliver fuel into the fuel rail, a first valve is disposed at the inlet of the high-pressure fuel pump, and a second valve is disposed in a return line that fluidly connects the fuel rail to a fuel tank. An electronic control unit is configured to monitor a value of a parameter indicative of a fuel quantity injected into the engine, monitor a value of an engine speed, and operate the first valve to allow a first fuel flow to be delivered from the high-pressure fuel pump into the fuel rail and contemporaneously operate the second valve to discharge a second fuel flow from the fuel rail, if the monitored value of the parameter indicates that no fuel is injected into the engine and the monitored value of the engine speed exceeds a predetermined threshold value thereof.

16 Claims, 2 Drawing Sheets

(51) Int. Cl.

| | |
|---|---|
| ***F02M 37/00*** | (2006.01) |
| ***F02D 41/12*** | (2006.01) |
| ***F02M 63/02*** | (2006.01) |
| *F02B 29/04* | (2006.01) |
| *F02B 37/00* | (2006.01) |
| *F02B 37/18* | (2006.01) |
| *F02M 26/05* | (2016.01) |
| *F02M 26/22* | (2016.01) |

(52) U.S. Cl.
CPC ..... *F02M 63/02* (2013.01); *F02B 29/04* (2013.01); *F02B 37/00* (2013.01); *F02B 37/18* (2013.01); *F02D 2200/0602* (2013.01); *F02D 2200/0614* (2013.01); *F02D 2200/101* (2013.01); *F02D 2200/602* (2013.01); *F02M 26/05* (2016.02); *F02M 26/22* (2016.02)

(58) Field of Classification Search
USPC ..... 123/459
See application file for complete search history.

(56) References Cited

U.S. PATENT DOCUMENTS

| | | | | |
|---|---|---|---|---|
| 6,912,983 | B2 * | 7/2005 | Okamoto | F02D 41/062 123/179.1 |
| 7,373,924 | B1 | 5/2008 | Krengel et al. | |
| 9,394,857 | B2 * | 7/2016 | Yudanov | F02M 63/0029 |
| 2005/0252200 | A1 | 11/2005 | Oono | |
| 2007/0034191 | A1 | 2/2007 | Oono | |
| 2009/0090331 | A1 * | 4/2009 | Pursifull | F02M 37/0058 123/446 |
| 2015/0090227 | A1 * | 4/2015 | Pursifull | F02M 59/366 123/446 |

* cited by examiner

FUEL INJECTION SYSTEM OF AN INTERNAL COMBUSTION ENGINE

CROSS-REFERENCE TO RELATED APPLICATION

This application claims priority to Great Britain Patent Application No. 1420184.2, filed Nov. 13, 2014, which is incorporated herein by reference in its entirety.

TECHNICAL FIELD

The present disclosure pertains to an internal combustion engine of a motor vehicle and to a method of operating the same. More specifically, the present disclosure relates to a fuel injection system of an internal combustion engine and to a method of operating the fuel injection system under fuel cut-off conditions.

BACKGROUND

It is known that modern internal combustion engines normally include a fuel injection system provided for injecting metered quantities of fuel into the engine, namely into the engine combustion chambers. Particularly for Diesel engines, the fuel injection system usually includes a low-pressure fuel pump, which receives fuel from a fuel tank and delivers the fuel into a low-pressure line, and a high-pressure fuel pump, which draws the fuel from the low-pressure fuel line and delivers the fuel into a high-pressure fuel rail. The high-pressure fuel rail is in fluid communication with one or more fuel injectors, each of which is arranged to inject the fuel directly into a corresponding combustion chamber of the engine.

Both the low-pressure fuel pump and the high-pressure fuel pump are usually driven by the engine crankshaft via transmission chains or belts, so that they actually continue to pump fuel as long as the engine is operating. For this reason, the fuel injection system is also provided with a number of valves, which are used to regulate the fuel circulation in response to the different engine operating conditions. These valves may include a first controllable valve, which is disposed at the inlet of the high-pressure fuel pump and a second controllable valve, which is disposed in a return line that fluidly connects the fuel rail to the fuel tank.

The first controllable valve may be an on/off valve, which is opened during the induction stroke of the high-pressure fuel pump and closed during the subsequent compression stroke. In this way, by regulating the timing between the closing of the valve and the end of the compression stroke, the fuel quantity delivered by the high-pressure fuel pump is efficiently adjusted. In order to compensate for the different quantities of fuel delivered by the high-pressure fuel pump, an additional overflow valve is normally disposed in the low-pressure fuel line to discharge part of the fuel coming from the low-pressure fuel pump back into the fuel tank.

The first and the second controllable valves may be electromechanically actuated valves controlled by an electronic control unit (ECU), which is generally configured to determine, on the basis of the engine operating conditions, a target value of the fuel rail internal pressure and to operate these valves in order to follow up said pressure target value.

Under fuel cut-off conditions, namely when the fuel injectors are closed and no fuel is injected into the engine combustion chambers, the ECU is normally configured to operate the first valve so that no additional fuel is supplied by the high-pressure fuel pump into the fuel rail, and to adjust the position of the second valve with a closed loop control logic aimed to progressively reduce the fuel rail internal pressure down to a minimum value thereof.

More specifically, the first valve, which is disposed at the inlet of the high-pressure fuel pump, is kept open both during the induction stroke and during the compression stroke of the pump, so that all the fuel drawn from the low-pressure fuel line is sent back to the pump inlet. To deal with this counter-flow of fuel, the overflow valve is conventionally integrated in the high-pressure fuel pump, so that the fuel coming back from the high-pressure fuel pump is immediately discharged into the fuel tank. This solution is quite effective, but the "integrated" high-pressure pump is becoming too heavy and expensive for modern engines, which are designed to reduce weights and costs as much as possible.

For this reason, some pump suppliers are proposing to realize the high-pressure fuel pump and the overflow valve as two separated components and to connect them by means of an intermediate line, thereby allowing the high-pressure fuel pump to be optimized both in term of weight and cost. However, when the first controllable valve is kept open under a fuel cut-off condition, this layout is unable to immediately discharge the fuel that comes back from the high-pressure fuel pump, thereby causing significant pressure fluctuations in the intermediate line. These pressure fluctuations, which are particularly intense for high values of the engine speed, may generate noises and mechanical stresses.

SUMMARY

The present disclosure provides an improved solution for operating a fuel injection system of an internal combustion engine under fuel cut-off conditions, which can be able to prevent or at least to positively reduce the pressure fluctuations that would be generated in the intermediate line connecting the overflow valve to the high-pressure fuel pump.

An embodiment of the present disclosure provides an internal combustion engine including at least a fuel injector in fluid communication with a fuel rail, a high-pressure fuel pump arranged to deliver fuel into the fuel rail, a first valve disposed at the inlet of the high-pressure fuel pump, a second valve disposed in a return line that fluidly connects the fuel rail to a fuel tank. An electronic control unit is configured to monitor a value of a parameter indicative of a fuel quantity injected into the engine and a value of an engine speed. The first valve is operated to allow a first fuel flow to be delivered from the high-pressure fuel pump into the fuel rail and contemporaneously operate the second valve to discharge a second fuel flow from the fuel rail back into the fuel tank, if the monitored value of the parameter indicates that no fuel is injected into the engine, and if the monitored value of the engine speed exceeds a predetermined threshold value thereof.

As a matter of fact, this solution provides for identifying the engine operating conditions under which the traditional control logic of the fuel injection system would cause intense pressure fluctuations in the low-pressure line, namely when the engine is rotating at high speed under a fuel cut-off condition (i.e. while no fuel is injected into the engine). When such operating conditions have been identified, the proposed solution provides for operating both the first valve and the second valve so that the fuel quantity drawn by the high-pressure fuel pump from the low-pressure line is at least partially delivered into the fuel rail and then immediately discharged into the fuel tank through the second valve, thereby maintaining a fuel circulation that prevents or at least positively reduces the pressure fluctuations in the low-pressure line.

According to an aspect of the present disclosure, the parameter indicative of the fuel quantity injected into the engine may be a position of an accelerator pedal. This aspect provides a reliable and simple solution to identify the fuel cut-off conditions, since they always and only occur when the accelerator pedal is in a completely released position.

According to another aspect of the present disclosure, the electronic control unit may be configured to allow the delivery of the first fuel flow from the high-pressure fuel pump into the fuel rail by closing the first valve before an end of a compression stroke of the high pressure fuel pump. This aspect has the effect of providing a simple and reliable way of allowing the high-pressure fuel pump to deliver the first fuel flow to the fuel rail.

According to still another aspect of the present disclosure, the electronic control unit may be configured to adjust a volumetric flow rate of the first fuel flow on the basis of the monitored value of the engine speed. This feed-forward control logic has the effect of regulating the volume of fuel that enters the fuel rail per unit time in accordance with the engine speed and thus in accordance with the frequency and intensity of the pressure fluctuations that would be generated by the high-pressure fuel pump in the low-pressure line.

According to an aspect of the present disclosure, the electronic control unit may be configured to adjust the volumetric flow rate of the first fuel flow by adjusting a timing between the closing of the first valve and the end of the compression stroke of the high pressure fuel pump. This aspect has the effect of providing a very simple way of regulating the volumetric flow rate of the first fuel flow.

Another aspect of the present disclosure provides that the electronic control unit may be configured to operate the first valve by supplying a pulsed electrical signal to an electric actuator thereof and to adjust the timing between the closing of the first valve and the end of the compression stroke of the high pressure fuel pump by adjusting a duty cycle of that pulsed electrical signal. This aspect has the effect of allowing a very precise regulation of the volumetric flow rate of the first fuel flow.

In particular, the electronic control unit may be configured to determine the value of the duty cycle of the pulsed electrical signal by means of a predetermined map correlating values of the engine speed to corresponding values of the duty cycle. This solution has the effect of allowing the electronic control unit to control the first valve with a minimum computational effort.

According to another aspect of the present disclosure, the electronic control unit may be configured to operate the second valve by supplying an amount of electrical power to an electric actuator thereof. This aspect has the effect of providing a simple and reliable way of controlling the operation of the second valve.

According to still another aspect of the present disclosure, the electronic control unit may be particularly configured to measure a value of a fuel rail internal pressure, calculate a difference between the measured value of the fuel rail internal pressure and a predetermined target value thereof, and adjust a volumetric flow rate of the second fuel flow in order to minimize said difference. This feedback control logic has the effect of regulating the volume of fuel that exits the fuel rail per unit time in such a way to achieve the target value of the fuel rail internal pressure and automatically compensate for the volume of fuel that contemporaneously enters the fuel rail with the first fuel flow.

In particular, the electronic control unit may be configured to adjust the volumetric flow rate of the second fuel flow by adjusting the amount of electrical power supplied to the electric actuator of the second valve. This aspect has the effect of providing a very simple way of regulating the volumetric flow rate of the second fuel flow.

Another embodiment of the present disclosure provides a method of operating an internal combustion engine, wherein the engine includes at least a fuel injector in fluid communication with a fuel rail, a high-pressure fuel pump arranged to deliver the fuel into the fuel rail, a first valve disposed at the inlet of the high-pressure fuel pump, and a second valve disposed in a return line that fluidly connects the fuel rail to a fuel tank. The operating method includes monitoring a value of a parameter indicative of a fuel quantity injected into the engine, monitoring a value of an engine speed, operating the first valve to allow a first fuel flow to be delivered from the high-pressure fuel pump into the fuel rail and contemporaneously operating the second valve to discharge a second fuel flow from the fuel rail back into the fuel tank, if the monitored value of the parameter indicates that no fuel is injected into the engine and if the monitored value of the engine speed exceeds a predetermined threshold value thereof.

This method of the present disclosure basically achieves the same advantages explained in connection with the internal combustion engine, in particular that of allowing a fuel circulation from the high-pressure fuel pump to the fuel rail and then back into the fuel tank, which prevents or at least positively reduce the pressure fluctuations in the low-pressure line when the engine is rotating at high speed under a cut-off condition (i.e. while no fuel is injected into the engine).

According to an aspect of the present disclosure, the parameter indicative of the fuel quantity injected into the engine may be a position of an accelerator pedal. This aspect provides a reliable and simple solution to identify the engine cut-off conditions, since they always and only occur when the accelerator pedal is in a completely released position.

According to another aspect of the present disclosure, the delivery of the first fuel flow from the high-pressure fuel pump into the fuel rail may be allowed by closing the first valve before an end of a compression stroke of the high pressure fuel pump. This aspect has the effect of providing a simple and reliable way of allowing the high-pressure fuel pump to deliver the first fuel flow to the fuel rail.

According to still another aspect of the present disclosure, the method may include the step of adjusting a volumetric flow rate of the first fuel flow on the basis of the monitored value of the engine speed. This feed-forward control logic has the effect of regulating the volume of fuel that enters the fuel rail per unit time in accordance with the engine speed and thus in accordance with the frequency and intensity of the pressure fluctuations that would be generated by the high-pressure fuel pump in the low-pressure line.

According to an aspect of the present disclosure, the volumetric flow rate of the first fuel flow may be adjusted by adjusting a timing between the closing of the first valve and the end of the compression stroke of the high-pressure fuel pump. This aspect has the effect of providing a very simple way of regulating the volumetric flow rate of the first fuel flow.

Another aspect of the present disclosure provides that the first valve may be operated by supplying a pulsed electrical signal to an electric actuator thereof and that the timing between the closing of the first valve and the end of the compression stroke of the high pressure fuel pump may be adjusted by adjusting a duty cycle of the pulsed electrical signal. This aspect has the effect of allowing a very precise regulation of the volumetric flow rate of the first fuel flow.

In particular, the duty cycle of the pulsed electrical signal may be determined by means of a predetermined map correlating values of the engine speed to corresponding values of the duty cycle. This solution has the effect of controlling the first valve with a minimum computational effort.

According to another aspect of the present disclosure, the second valve may be operated by supplying an amount of electrical power to an electric actuator thereof. This aspect has the effect of providing a simple and reliable way of controlling the operation of the second valve.

According to still another aspect of the present disclosure, the method may be configured to measure a value of a fuel rail internal pressure, calculate a difference between the measured value of the fuel rail internal pressure and a predetermined target value thereof, and adjust a volumetric flow rate of the second fuel flow in order to minimize said difference. This feedback control logic has the effect of regulating the volume of fuel that exits the fuel rail per unit time in such a way to achieve the target value of the fuel rail internal pressure and automatically compensate for the volume of fuel that contemporaneously enters the fuel rail with the first fuel flow.

In particular, the volumetric flow rate of the second fuel flow may be adjusted by adjusting the amount of electrical power supplied to the electric actuator of the second valve. This aspect has the effect of providing a very simple way of regulating the volumetric flow rate of the second fuel flow.

The method of the present disclosure can be carried out with the help of a computer program including a program-code for carrying out all the steps of the method described above, and in the form of a computer program product including the computer program. The method can be also embodied as an electromagnetic signal modulated to carry a sequence of data bits, which represent a computer program to carry out all steps of the method.

A control system of an internal combustion engine, wherein the internal combustion engine includes at least a fuel injector in fluid communication with a fuel rail, a high-pressure fuel pump arranged to deliver the fuel into the fuel rail, a first valve disposed at the inlet of the high-pressure fuel pump, a second valve disposed in a return line that fluidly connects the fuel rail to a fuel tank. The control system includes sensors configured to monitor a value of a parameter indicative of a fuel quantity injected into the engine and a value of an engine speed. An actuator configured to operate the first valve to allow a first fuel flow to be delivered from the high-pressure fuel pump into the fuel rail and contemporaneously for operating the second valve to discharge a second fuel flow from the fuel rail back into the fuel tank, if the monitored value of the parameter indicates that no fuel is injected into the engine and if the monitored value of the engine speed exceeds a predetermined threshold value thereof.

This further embodiment of the present disclosure basically achieves the same advantages explained in connection with the first embodiment, in particular that of allowing a fuel circulation from the high-pressure fuel pump to the fuel rail and then back into the fuel tank, which prevents or at least positively reduce the pressure fluctuations in the low-pressure line when the engine is rotating at high speed under a cut-off condition (i.e. while no fuel is injected into the engine).

According to an aspect of the present disclosure, the parameter indicative of the fuel quantity injected into the engine may be a position of an accelerator pedal. This aspect provides a reliable and simple solution to identify the engine cut-off conditions, since they always and only occur when the accelerator pedal is in a completely released position.

According to another aspect of the present disclosure, the actuator is configured to operate the first valve to allow the delivery of the first fuel flow from the high-pressure fuel pump into the fuel rail and includes means for closing the first valve before an end of a compression stroke of the high-pressure fuel pump. This aspect has the effect of providing a simple and reliable way of allowing the high-pressure fuel pump to deliver the first fuel flow to the fuel rail.

According to still another aspect of the present disclosure, the actuator is configured to operate the first valve and may include means for adjusting a volumetric flow rate of the first fuel flow on the basis of the monitored value of the engine speed. This feed-forward control logic has the effect of regulating the volume of fuel that enters the fuel rail per unit time in accordance with the engine speed and thus in accordance with the frequency and intensity of the pressure fluctuations that would be generated by the high-pressure fuel pump in the low-pressure line.

According to an aspect of the present disclosure, the means for adjusting the volumetric flow rate of the first fuel flow and may include means for adjusting a timing between the closing of the first valve and the end of the compression stroke of the high pressure fuel pump. This aspect has the effect of providing a very simple way of regulating the volumetric flow rate of the first fuel flow.

Another aspect of the present disclosure provides that the actuator is configured to operate the first valve and may include means for supplying a pulsed electrical signal to an electric actuator thereof, and that the means for adjusting the timing between the closing of the first valve and the end of the compression stroke of the high pressure fuel pump may include means for adjusting a duty cycle of the pulsed electrical signal. This aspect has the effect of allowing a very precise regulation of the volumetric flow rate of the first fuel flow.

In particular, the means for adjusting a duty cycle of the pulsed electrical signal may include means for determining the value of the duty cycle of the pulsed electrical signal by means of a predetermined map correlating values of the engine speed to corresponding values of the duty cycle. This solution has the effect of controlling the first valve with a minimum computational effort.

According to another aspect of the present disclosure, the actuator is configured to operate the second valve and may include means for supplying an amount of electrical power to an electric actuator thereof. This aspect has the effect of providing a simple and reliable way of controlling the operation of the second valve.

According to still another aspect of the present disclosure, the actuator is configured to operate the second valve and may further include a sensor for measuring a value of a fuel rail internal pressure, means for calculating a difference between the measured value of the fuel rail internal pressure and a predetermined target value thereof, and means for adjusting a volumetric flow rate of the second fuel flow in order to minimize said difference. This feedback control logic has the effect of regulating the volume of fuel that exits the fuel rail per unit time in such a way to achieve the target value of the fuel rail internal pressure and automatically compensate for the volume of fuel that contemporaneously enters the fuel rail with the first fuel flow.

In particular, the means for adjusting the volumetric flow rate of the second fuel flow may include means for adjusting the amount of electrical power supplied to the electric actuator of the second valve. This aspect has the effect of providing a very simple way of regulating the volumetric flow rate of the second fuel flow.

BRIEF DESCRIPTION OF THE DRAWINGS

The present disclosure will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any theory presented in the preceding background of the invention or the following detailed description.

Figure 1:
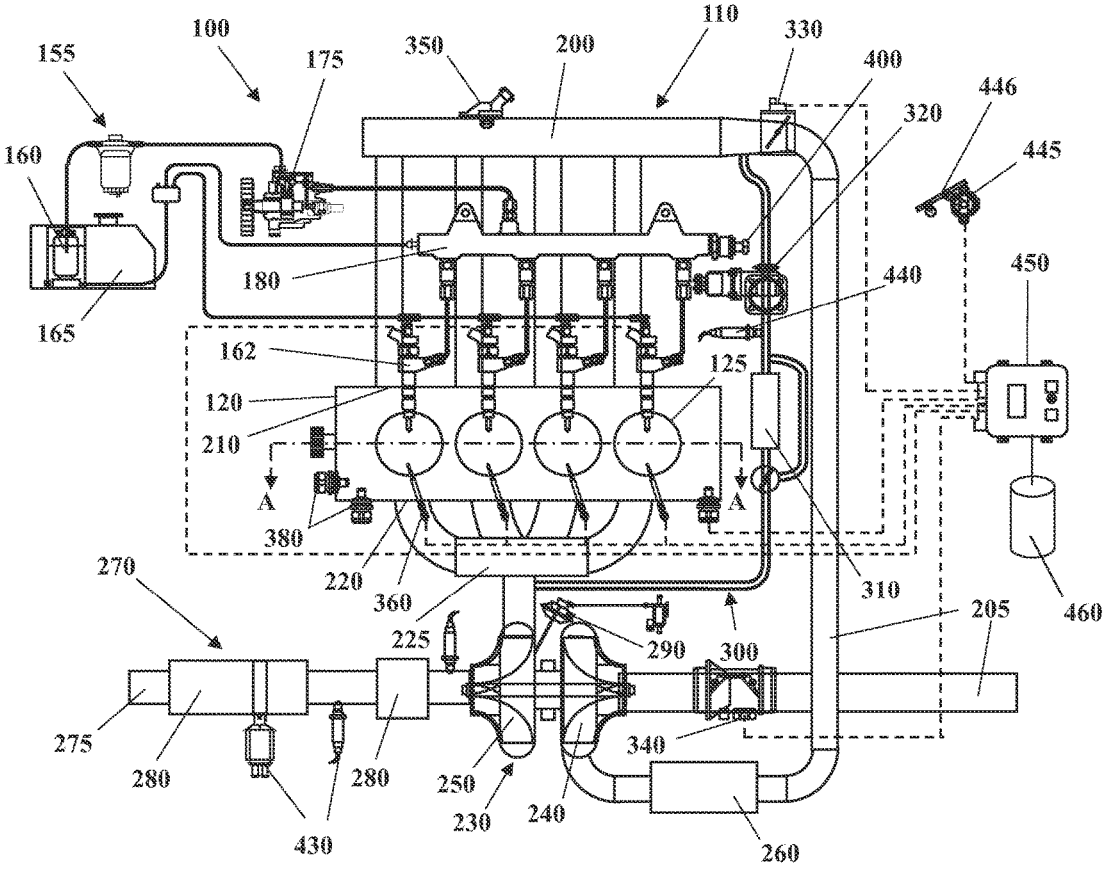
FIG. 1 schematically shows an automotive system according to an embodiment of the present disclosure.
Figure 2:
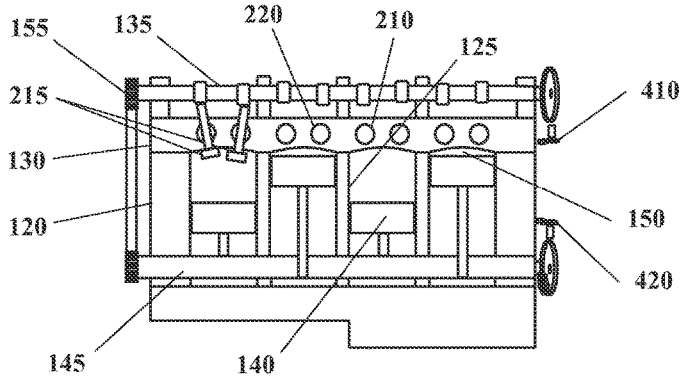
FIG. 2 is the section A-A of an internal combustion engine belonging to the automotive system of FIG. 1.

Some embodiments may include an automotive system 100, as shown in FIGS. 1 and 2, that includes an internal combustion engine (ICE) 110 having an engine block 120 defining at least one cylinder 125 having a piston 140 coupled to rotate a crankshaft 145. A cylinder head 130 cooperates with the piston 140 to define a combustion chamber 150. A fuel and air mixture (not shown) is disposed in the combustion chamber 150 and ignited, resulting in hot expanding exhaust gasses causing reciprocal movement of the piston 140. The air is provided through at least one intake port 210 and the fuel is provided by a fuel injection system 155.

Each of the cylinders 125 has at least two valves 215, actuated by a camshaft 135 rotating in time with the crankshaft 145. The valves 215 selectively allow air into the combustion chamber 150 from the port 210 and alternately allow exhaust gases to exit through a port 220. In some examples, a cam phaser 137 may selectively vary the timing between the camshaft 135 and the crankshaft 145.

The air may be distributed to the air intake port(s) 210 through an intake manifold 200. An air intake duct 205 may provide air from the ambient environment to the intake manifold 200. In other embodiments, a throttle body 330 may be provided to regulate the flow of air into the manifold 200. In still other embodiments, a forced air system such as a turbocharger 230, having a compressor 240 rotationally coupled to a turbine 250, may be provided. Rotation of the compressor 240 increases the pressure and temperature of the air in the duct 205 and manifold 200. An intercooler 260 disposed in the duct 205 may reduce the temperature of the air. The turbine 250 rotates by receiving exhaust gases from an exhaust manifold 225 that directs exhaust gases from the exhaust ports 220 and through a series of vanes prior to expansion through the turbine 250. The exhaust gases exit the turbine 250 and are directed into an exhaust system 270. This example shows a variable geometry turbine (VGT) with a VGT actuator 290 arranged to move the vanes to alter the flow of the exhaust gases through the turbine 250. In other embodiments, the turbocharger 230 may be fixed geometry and/or include a waste gate.

The exhaust system 270 may include an exhaust pipe 275 having one or more exhaust after treatment devices 280. The after treatment devices may be any device configured to change the composition of the exhaust gases. Some examples of after treatment devices 280 include, but are not limited to, catalytic converters (two and three way), oxidation catalysts, lean NOx traps, hydrocarbon adsorbers, selective catalytic reduction (SCR) systems, and particulate filters. Other embodiments may include an exhaust gas recirculation (EGR) system 300 coupled between the exhaust manifold 225 and the intake manifold 200. The EGR system 300 may include an EGR cooler 310 to reduce the temperature of the exhaust gases in the EGR system 300. An EGR valve 320 regulates a flow of exhaust gases in the EGR system 300.

Figure 3:
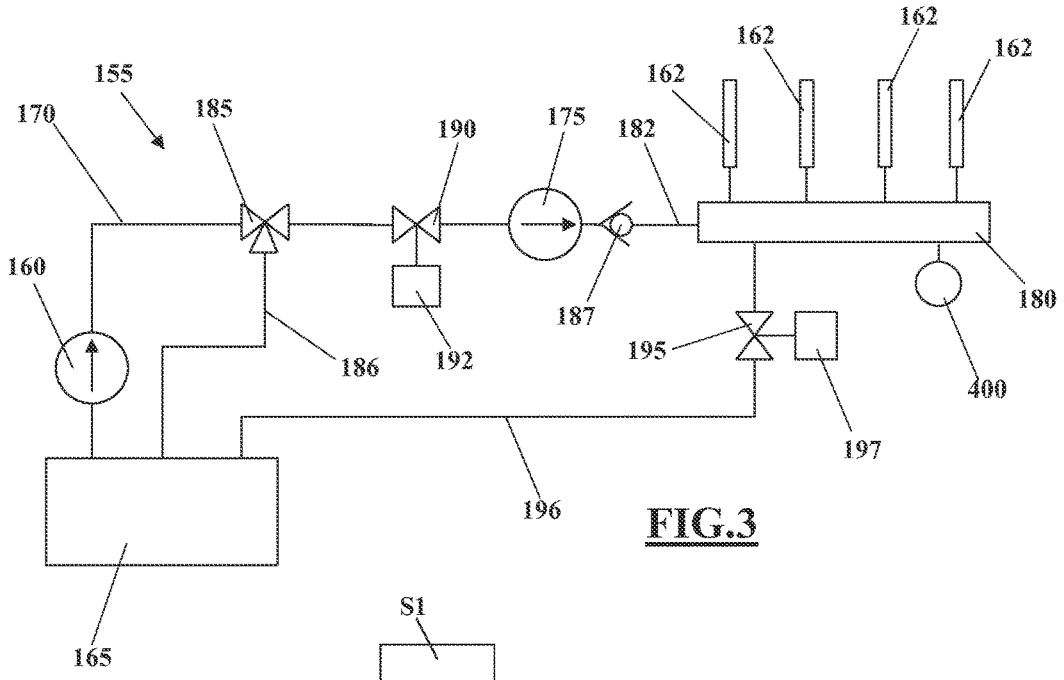
FIG. 3 is a schematic representation of a fuel injection system of the automotive system of FIG. 1.

Turning now to the fuel injection system 155 (see. FIG. 3), this apparatus may include a low-pressure fuel pump 160 having an inlet fluid in communication with a fuel tank 165 and an outlet in fluid communication with a low-pressure fuel line 170. In this way, the low-pressure fuel pump 160 is arranged to receive fuel from the fuel tank 165 and deliver the fuel into the low-pressure fuel line 170. The low-pressure fuel pump 160, which may be a piston pump, may be driven by the engine crankshaft 145, for example through a transmission belt or chain. The fuel injection system 155 may also include a high-pressure fuel pump 175 having an inlet in fluid communication with the low-pressure fuel line 170 and an outlet in fluid communication with a fuel rail 180. In this way, the high-pressure fuel pump 175 is arranged to receive fuel from the low-pressure fuel line 170 and to deliver the fuel at higher pressure to the fuel rail 180 via a high-pressure line 182. The high-pressure fuel pump 175, which may be a piston pump, may be driven by the engine crankshaft 145, for example through a transmission belt or chain. The fuel injection system 155 further includes at least one fuel injector 162 per engine combustion chamber 150, which is in fluid communication with the fuel rail 180. Each fuel injector 162 may be disposed in the cylinder head 130 to be able to inject metered quantities of fuel from the fuel rail 180 directly into the corresponding combustion chamber 150. A pressure sensor 400 may be disposed in the fuel rail 180 to measure the internal pressure thereof.

In order to regulate the circulation of fuel, the fuel injection system 155 may include a overflow valve 185 disposed in the low-pressure fuel line 170 to distribute the fuel flow coming from the low-pressure fuel pump 160 partly to the high-pressure fuel pump 175 and partly back into the fuel tank 165. In this way, the overflow valve 185 is able to regulate the volumetric flow rate of fuel that is actually provided to the high-pressure fuel pump 175. The overflow valve 185 may be a three-way valve having an inlet in fluid communication with the outlet of the low-pressure fuel pump 160, a first outlet in fluid communication with the inlet of the high-pressure fuel pump 175 and a second outlet in fluid communication with a return line 186 leading directly into the fuel tank 165. The overflow valve 185 may be internally provided with a movable valve member which is able to move between a first end position, where it completely closes the second outlet thereby directing all the fuel flow to the high-pressure fuel pump 175, and a second end position, where it lets the second outlet completely open thereby directing almost all the fuel flow back into the fuel tank 165. In order to regulate the volumetric flow rate of fuel that is provided to the high-pressure fuel pump 175, the movable valve member may also be arrested in a plurality of intermediate positions. The overflow valve 185 may be a mechanically actuated valve and the valve member may move automatically under the effect of the pressure difference between the inlet and the first outlet of the overflow valve. According to some embodiments, the overflow valve 185 may be realized as a separated component with respect to the high-pressure fuel pump 175 and may be connected to the latter via an intermediate line, which is part of the low-pressure fuel line 170.

The fuel injection system 155 may further include a check valve 187 disposed in the high-pressure fuel line 182, which is normally closed and automatically opens when the pressure of the fuel delivered by the high-pressure fuel pump 175 exceeds the pressure of the fuel within the fuel rail 180. In particular, the check valve 182 may be a two-way valve having an inlet in fluid communication with the outlet of high-pressure fuel pump 175 and an outlet in fluid communication with the fuel rail 180. The check valve 187 may be internally provided with a valve member (e.g. a ball) which is biased by a spring in a first position, where it completely closes the communication between the inlet and the outlet, and which can move, under the pressure of the fuel coming from the high-pressure fuel pump 175, towards a second position, where it opens the communication. In some embodiments, the check valve 187 may be integrated in the high-pressure fuel pump 175.

The fuel injection system 155 may further include a first controllable valve 190 disposed in the low-pressure fuel line 170 at the inlet of the high-pressure fuel pump 175 (i.e. between the overflow valve 185 and the high-pressure fuel pump 175), which is configured to regulate the volumetric flow rate of the fuel that is delivered by the high-pressure fuel pump 175. In particular, the first valve 190 may be a two-way valve having an inlet in fluid communication with the outlet of the overflow valve 185 and an outlet in fluid communication with the inlet of high-pressure fuel pump 175. The first valve 190 may be internally provided with a movable valve member, which is able to move between a first end position, where it completely closes the communication between the inlet and the outlet, and a second end position, where it lets the communication completely open. The valve member is moved into the second end position (i.e. opened) during the compression stroke of the high-pressure fuel pump 170 and into the first end position (i.e. closed) during the subsequent compression stroke. In order to regulate the volumetric flow rate of the fuel that is actually delivered to the fuel rail 180, the timing between the closing of the valve 190 and the end of the compression stroke may be regulated. In particular, the first valve 190 may be an electromechanically actuated valve, which includes an electric actuator 192 for moving and arresting the valve member in the first and second end positions. When no electrical power is supplied to the electric actuator 192, the valve member remains in the first end position, thereby completely closing the first valve 190. When conversely an amount of electrical power is supplied to the electric actuator 192, the valve member moves in the second end position, thereby completely opening the first valve 190. In particular, the first valve 190 may be a so-called digital on/off valve, whose electric actuator 192 is electrically powered by means of a pulsed (e.g. square) electrical signal. By adjusting the duty-cycle of this pulsed electrical signal, it is possible to regulate the instant in which the valve 190 closes thereby regulating the quantity of fuel delivered by the high-pressure fuel pump 175 per compression stroke.

The fuel injection system 155 may also include a second controllable valve 195, also referred as pressure regulating valve, which is disposed in a return line 196 that fluidly connects the fuel rail 180 to the fuel tank 165. In this way, the second valve 195 is able to discharge part of the fuel contained in the fuel rail 180 back into the fuel tank 165. In particular, the second valve 195 may be a two-way valve having an inlet in fluid communication with the fuel rail 180 and an outlet in fluid communication with the fuel tank 165. The second valve 195 may be internally provided with a movable valve member, which is able to move to and fro between a first end position, where it completely closes the communication between the inlet and the outlet, and a second end position, where it lets the communication completely open. In order to regulate the volumetric flow rate of fuel that is actually discharged into the fuel rail 180, the valve member may also be arrested in a plurality of intermediate positions. The second valve 195 may be an electromechanically actuated valve, which includes an electric actuator 197 for moving and arresting the valve member in the different positions. When no electrical power is supplied to the electric actuator 197, the valve member remains in the first end position, thereby completely closing the second valve 195. When conversely a maximum amount of electrical power is supplied to the electric actuator 197, the valve member moves in the second end position, thereby completely opening the second valve 195. By regulating the amount of the electrical power supplied to the electric actuator 197, the valve member is moved and arrested in corresponding intermediate positions.

The automotive system 100 may further include an electronic control unit (ECU) 450 in communication with one or more sensors and/or devices associated with the ICE 110. The ECU 450 may receive input signals from various sensors configured to generate the signals in proportion to various physical parameters associated with the ICE 110. The sensors include, but are not limited to, a mass airflow and temperature sensor 340, a manifold pressure and temperature sensor 350, a combustion pressure sensor 360, coolant and oil temperature and level sensors 380, the fuel rail pressure sensor 400, a cam position sensor 410, a crank position sensor 420, exhaust pressure and temperature sensors 430, an EGR temperature sensor 440, and a position sensor 445 of an accelerator pedal 446. Furthermore, the ECU 450 may generate output signals to various control devices that are arranged to control the operation of the ICE 110, including, but not limited to, the fuel injectors 162, the throttle body 330, the EGR Valve 320, the VGT actuator 290, and the cam phaser 137, the electric actuators 192 and 197. Note, dashed lines are used to indicate communication between the ECU 450 and the various sensors and devices, but some are omitted for clarity.

Turning now to the ECU 450, this apparatus may include a digital central processing unit (CPU) in communication with a memory system and an interface bus. The CPU is configured to execute instructions stored as a program in the memory system 460, and send and receive signals to/from the interface bus. The memory system 460 may include various storage types including optical storage, magnetic storage, solid-state storage, and other non-volatile memory. The interface bus may be configured to send, receive, and modulate analog and/or digital signals to/from the various sensors and control devices. The program may embody the methods disclosed herein, allowing the CPU to carryout out the steps of such methods and control the ICE 110.

The program stored in the memory system 460 is transmitted from outside via a cable or in a wireless fashion. Outside the automotive system 100 it is normally visible as a computer program product, which is also called computer readable medium or machine readable medium in the art, and which should be understood to be a computer program code residing on a carrier, said carrier being transitory or non-transitory in nature with the consequence that the computer program product can be regarded to be transitory or non-transitory in nature.

An example of a transitory computer program product is a signal, e.g. an electromagnetic signal such as an optical signal, which is a transitory carrier for the computer program code. Carrying such computer program code can be achieved by modulating the signal by a conventional modulation technique such as QPSK for digital data, such that binary data representing said computer program code is impressed on the transitory electromagnetic signal. Such signals are e.g. made use of when transmitting computer program code in a wireless fashion via a WiFi connection to a laptop.

In case of a non-transitory computer program product the computer program code is embodied in a tangible storage medium. The storage medium is then the non-transitory carrier mentioned above, such that the computer program code is permanently or non-permanently stored in a retrievable way in or on this storage medium. The storage medium can be of conventional type known in computer technology such as a flash memory, an Asic, a CD or the like.

Instead of an ECU 450, the automotive system 100 may have a different type of processor to provide the electronic logic, e.g. an embedded controller, an onboard computer, or any processing module that might be deployed in the vehicle.

During the operation of the internal combustion engine 110, the ECU 450 is generally configured to determine a value of a fuel quantity to be injected into the engine combustion chambers 150 per engine cycle, and then to actuate the fuel injectors 162 accordingly. The value of the fuel quantity to be injected may be determined by the ECU 450 on the basis the position of the accelerator pedal 446 as measured by the position sensor 445. The determined fuel quantity value is then injected by opening the fuel injector 162 for a corresponding time, usually referred as energizing time, which is calculated taking also into account the fuel pressure within the fuel rail 180 as measured by the pressure sensor 400.

Figure 4:
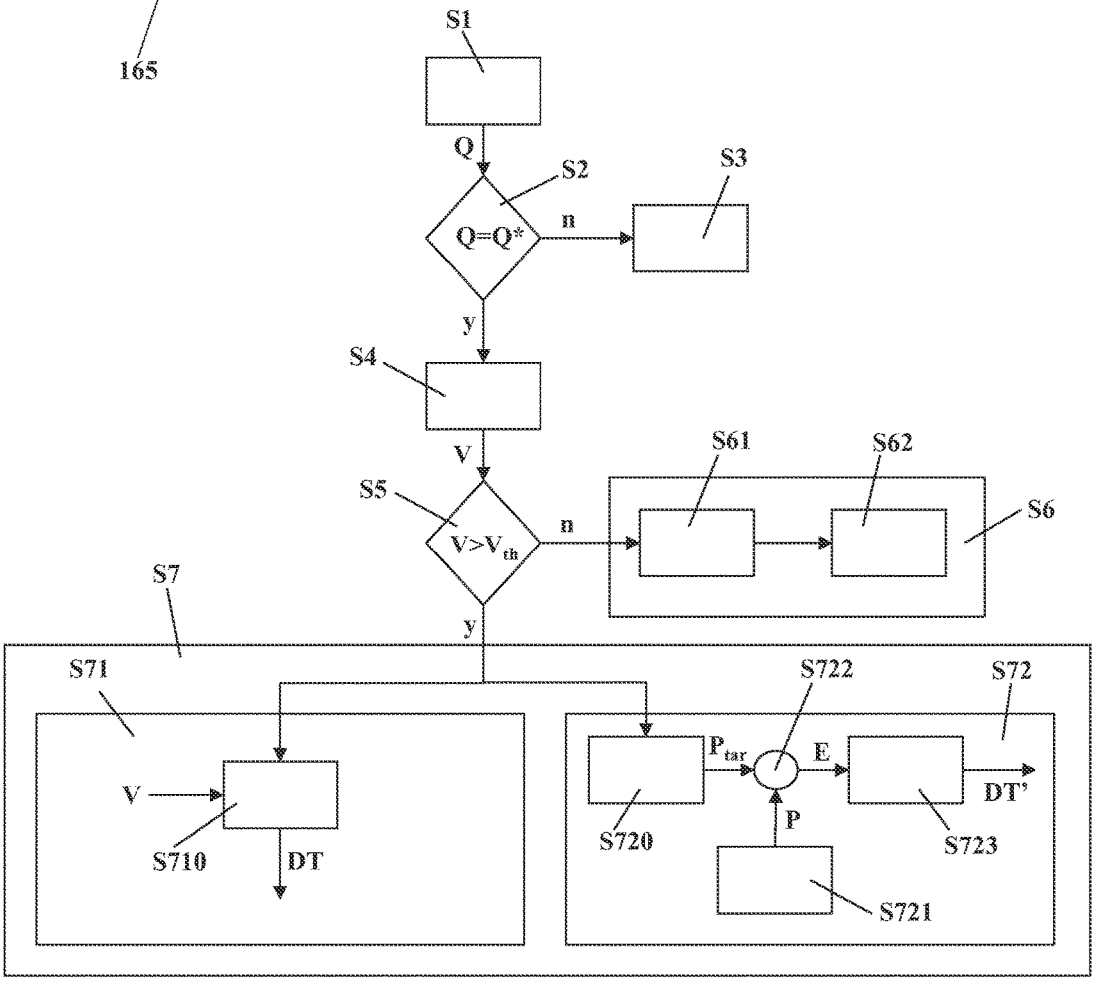
FIG. 4 is a flowchart representing a method of operating the fuel injection system of FIG. 3.

While operating the fuel injectors 162, the ECU 450 may also be configured to control the operation of the first valve 190 and of the second valve 195. To perform this task (see FIG. 4), the ECU 450 may be configured to monitor (block S1) a value Q of a parameter indicative of the fuel quantity that is currently injected by the fuel injectors 162 into the combustion chambers 150. This parameter may be for example the position of the accelerator pedal 446 and its value Q may be monitored (i.e. measured) with the position sensor 445. The ECU 450 may be configured to compare (block S2) the monitored value Q with a predetermined base value Q* of the parameter, which corresponds to a condition in which no fuel is actually injected into the engine combustion chambers 150.

As long as the monitored value Q of the parameter indicates that the fuel injectors 162 are actually injecting some fuel into the combustion chambers 150, for example as long as the monitored value Q differs from the base value Q* (e.g. the position sensor 445 senses that the accelerator pedal 446 is not in a completely released position), the ECU 450 may be configured to operate the first and the second valves 190 and 195 according to a first control strategy (block S3). In accordance with this first control strategy, the ECU 450 may be configured to operate both the first and second valves 190 and 195 so that the fuel pressure within the fuel rail 180 follows up a predetermined target value thereof.

If conversely the monitored value Q of the parameter indicates that the fuel injectors 162 are kept closed and that no fuel is actually injected into the combustion chambers 150 (i.e. fuel cut-off condition), for example if the monitored value Q is equal to the base value Q* (e.g. the position sensor 445 senses that the accelerator pedal 446 is in a completely released position), the ECU 450 may be configured to monitor a value V of the engine speed (block S4) and to compare the monitored value V of the engine speed with a predetermined threshold value $V_{th}$ thereof (block S5). The engine speed value V may be monitored (i.e. measured) by means of the crank position sensor 420. The threshold value $V_{th}$ of the engine speed may be a calibration value to be determined with an experimental activity and may represents the value of the engine speed above which the high-pressure fuel pump 175 could generate intense pressure fluctuations in the low-pressure fuel line 170.

If the monitored value V of the engine speed is equal or below the threshold value $V_{th}$, the ECU 450 may be configured to operate the first and the second valves 190 and 195 according to a second control strategy (block S6). In accordance with this second control strategy, the ECU 450 may be configured to operate the first valve 190 to completely prevent the high-pressure fuel pump 175 from delivering fuel to the fuel rail 180 (block S61) (e.g. by keeping the valve 190 always open, both during the induction stroke and during the compression stroke of the pump), and contemporaneously to adjust the position of the second valve 195 so that the pressure within the fuel rail 180 follows up a predetermined target value thereof (block S62).

If conversely the monitored value V of the engine speed is above the threshold value $V_{th}$, the ECU 450 may be configured to operate the first and the second valves 190 and 195 according to a third control strategy (block S7), which is aimed to prevent pressure fluctuations in the low-pressure fuel line 170. In accordance with this third control strategy, the ECU 450 may be configured to operate the first valve 190 to let the high-pressure fuel pump 175 deliver at least part of the fuel drawn from the low-pressure fuel line 170 to the fuel rail 180 (block S71), and contemporaneously to operate the second valve 195 to let the communication between the fuel rail 180 and the fuel tank 165 at least partially open (block S72). In this way, while a first fuel flow is allowed to be delivered from the high-pressure fuel pump 175 into the fuel rail 180, a second fuel flow is allowed to be discharged from the fuel rail 180 back into the fuel tank 165, thereby generating a fuel circulation that prevents or at least positively reduce the pressure fluctuations in the low-pressure fuel line 170.

According to some embodiments, the ECU 450 may be configured to operate the first valve 190 according to a feed-forward control logic that provides for adjusting the volumetric flow rate of the first fuel flow that is allowed to be delivered from the high-pressure fuel pump 175 to the fuel rail 180 on the basis of the monitored value V of the engine speed. Since the first valve 190 may be a digital on/off valve, the volumetric flow rate of the first fuel flow may be adjusted by adjusting the value of the duty cycle of the pulsed (e.g. square) electric signal used to power the electric actuator 192, in order to regulate the timing between the closing of the valve 190 and the end of the compression strokes of the high-pressure fuel pump 175. By way of example, the ECU 450 may be configured to determine the value DT of the duty cycle of the pulsed electric signal by means of a map (block S710) that correlates values of the engine speed to correspondent values of the duty cycle. This map may be a calibration map, which may be determined through an experimental activity aimed to determine, for each value of the engine speed, a correspondent value of the duty cycle that allows to eliminate or at least significantly reduce the pressure fluctuations in the low-pressure fuel line 170. This experimental activity may be carried out on a test bench or on a test vehicle and the map may then be memorized in the memory system 460 of the automotive system 100.

Contemporaneously, the ECU 450 may be configured to operate the second valve 195 according to a feedback control logic that provides for determining a target value $P_{tar}$ of the fuel pressure within the fuel rail 180 (block S720), measuring a value P of the fuel pressure within the fuel rail 180 by means of the pressure sensor 400 (block S721), calculating a difference E between the target value $P_{tar}$ and the measured value P of the fuel rail internal pressure (block S722), and adjusting the amount of electrical power supplied to the electric actuator 197 on the basis of the calculated difference D, thereby correspondently adjusting the position of the second valve 195 (i.e. of its movable member) and so the volumetric flow rate of the second fuel flow that is allowed to be discharged from the fuel rail 180 back into the fuel tank 165. In particular, the calculated difference E may be used as input of a controller (S723), for example a proportional-integrative controller, which is configured to minimize the difference D by yielding as output an adjusted value of the electrical power. Since the second valve 195 may be a digital valve, the electrical power supplied to the electric actuator 197 may be adjusted by adjusting the value DT' of the duty cycle of the pulsed (e.g. square) electric signal used to power the electric actuator 197. Thanks to this feedback control logic, the volumetric flow rate of the second fuel flow that exits the fuel rail 180 is always automatically adjusted to compensate for the volumetric flow rate of the first fuel flow that enters the fuel rail 180, thereby guaranteeing that the fuel rail inner pressure follows up the target value $P_{tar}$ thereof.

The target value $P_{tar}$ of the fuel rail inner pressure may be determined by the ECU 450 on the basis of several engine operating parameters, according to conventional strategies and/or logics. However, once the fuel cut-off condition has been identified (block S2), the ECU 450 is generally configured to progressively decrease the target value $P_{tar}$ of the fuel rail inner pressure down to a minimum value thereof. As a consequence, the first valve 190 and the second valve 195 will be generally controlled so that the volumetric flow rate of the second fuel flow that exits the fuel rail 180 is always bigger than, or at most equal to, the volumetric flow rate of the first fuel flow that enters the fuel rail 180.

In conclusion it should be observed that, while the internal combustion engine 110 is operating under a fuel cut-off condition, the engine speed value V progressively decreases, so that it may also decrease below the threshold value $V_{th}$ (block S5). If that happens, the ECU 450 switches from the third control strategy (block S7) to the second control strategy (block S6), thereby completely closing the first valve 190 while continuing to control the second valve 195 according to the feedback control logic explained above.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

What is claimed is:

1. An internal combustion engine comprising at least one fuel injector in fluid communication with a fuel rail, a fuel pump arranged to deliver fuel into the fuel rail, a first valve disposed at the inlet of the fuel pump, a second valve disposed in a return line that fluidly connects the fuel rail to a fuel tank, and an electronic control unit configured to:

monitor a value of a parameter indicative of a fuel quantity injected into the engine;

monitor a value indicative of an engine speed;

execute a fuel cut-off operation to prevent fuel delivery from the fuel pump through the at least one fuel injector when the monitored value of the parameter indicates that no fuel is injected into the engine including:

operate the first valve to allow a first fuel flow to be delivered from the fuel pump into the fuel rail and contemporaneously operate the second valve to discharge a second fuel flow from the fuel rail back into the fuel tank when the monitored value of the engine speed exceeds a predetermined threshold value thereof; and execute a normal fuel injection operation for delivering fuel from the fuel pump through the fuel rail and the at least one fuel injector when the monitored value of the parameter indicates that fuel is injected into the engine.

2. The internal combustion engine according to claim 1, wherein the parameter indicative of the fuel quantity injected into the engine comprises a position of an accelerator pedal.

3. The internal combustion engine according to claim 1, wherein the electronic control unit is further configured to:

measure a value of a fuel rail internal pressure;

calculate a difference between the measured value of the fuel rail internal pressure and a predetermined target value thereof; and adjust a volumetric flow rate of the second fuel flow in order to minimize said difference.

4. The internal combustion engine according to claim 1, further comprising an engine crankshaft driving the fuel pump and a crank position sensor, wherein the electronic control unit is configured to allow the delivery of the first fuel flow from the fuel pump into the fuel rail by closing the first valve before an end of a compression stroke of the fuel pump.

5. The internal combustion engine according to claim 1, wherein the electronic control unit is configured to operate the first valve for preventing fuel delivery from the fuel pump to the fuel rail and contemporaneously operate the second valve to control a fuel pressure in the fuel rail when the monitored value of the engine speed is less than or equal to a predetermined threshold value thereof when executing the fuel cut-out operation.

6. The internal combustion engine according to claim 1, wherein the electronic control unit is configured to adjust a volumetric flow rate of the first fuel flow on the basis of the monitored value of the engine speed.

7. The internal combustion engine according to claim 6, wherein the electronic control unit is configured to operate the first valve by supplying a pulsed electrical signal to an electric actuator thereof and to adjust the timing between the first valve and the fuel pump by adjusting a duty cycle of the pulsed electrical signal.

8. The internal combustion engine according to claim 7, wherein the electronic control unit is configured to determine the value of the duty cycle of the pulsed electrical signal using a predetermined map correlating values of the engine speed to corresponding values of the duty cycle.

9. The internal combustion engine according to claim 6, further comprising an engine crankshaft driving the fuel pump and a crank position sensor, wherein the electronic control unit is further configured to adjust the volumetric flow rate of the first fuel flow by adjusting a timing between the closing of the first valve and the end of the compression stroke of the fuel pump.

10. The internal combustion engine according to claim 1, wherein the electronic control unit is configured to operate the second valve by supplying an amount of electrical power to an electric actuator thereof.

11. The internal combustion engine according to claim 10, wherein the electronic control unit is configured to adjust the volumetric flow rate of the second fuel flow by adjusting the amount of electrical power supplied to the electric actuator of the second valve.

12. A method of operating an internal combustion engine having at least a fuel injector, a fuel pump arranged to deliver fuel into the fuel rail, a first valve disposed at the inlet of the fuel pump, and a second valve disposed in a return line that fluidly connects the fuel rail to the fuel tank, and wherein the operating method comprises:

monitoring a value of a parameter indicative of a fuel quantity injected into the engine;

monitoring a value of indicative of an engine speed;

executing a fuel cut-off operation to prevent fuel delivery from the fuel pump through the at least one fuel injector when-the monitored value of the parameter indicates that no fuel is injected into the engine including:

operating the first valve to allow a first fuel flow to be delivered from the fuel pump into the fuel rail and contemporaneously operating the second valve to discharge a second fuel flow from the fuel rail back into the fuel tank when the monitored value of the parameter indicates that no fuel is injected into the engine and the monitored value of the engine speed exceeds a predetermined threshold value thereof; and executing a normal fuel injection operation for delivering fuel from the fuel pump through the fuel rail and the at least one fuel injector when the monitored value of the parameter indicates that fuel is injected into the engine.

13. The method according to claim 12, wherein executing the fuel cut-off operation further comprises operating the first valve for preventing fuel delivery from the fuel pump to the fuel rail and contemporaneously operating the second valve to control a fuel pressure in the fuel rail when the monitored value of the engine speed is less than or equal to a predetermined threshold value thereof.

14. A fuel injection system comprising:

a low pressure fuel line fluidly coupled with a fuel tank;

a high pressure fuel line fluidly coupled with a fuel rail;

a fuel return line fluidly coupled to the fuel rail and the fuel tank;

a fuel pump fluidly coupled to the low pressure fuel line and the high pressure fuel line and operable to deliver fuel to the fuel rail in a pressurized state;

a first valve operable to control a first fuel flow through the high pressure fuel line from the fuel pump to the fuel rail;

a second valve operable to control a second fuel flow through the return line from the fuel rail to the fuel tank; and a non-transitory computer program product that, by a processor, monitors a parameter indicative of a fuel quantity injected into the engine and an engine speed, executes a normal fuel operation including controlling the first valve for delivering fuel from the fuel pump through the fuel rail and the at least one fuel injector when the monitored parameter indicates a fuel feed condition, and executes a fuel cut-off operation to prevent fuel delivery from the fuel pump through the at least one fuel injector including simultaneously controlling the first and second valves such that a first fuel quantity delivered to the fuel rail by the fuel pump and a second fuel quantity is simultaneously discharged from the fuel rail to the fuel tank when the monitored parameter indicates a fuel cut-out condition and the engine speed exceeds a predetermined threshold value thereof.

15. The fuel injection system according to claim 14, further comprising a non-transitory computer program product that, by a processor, measures a fuel rail pressure, calculates a pressure difference between the measured fuel rail pressure and a predetermined target pressure, and adjusts the second fuel flow for minimizing the pressure difference.

16. The fuel injection system according to claim 14, wherein a non-transitory computer program product that, by a processor, executes the fuel cut-off operation further comprising operating the first valve for preventing fuel delivery from the fuel pump to the fuel rail and contemporaneously operating the second valve to control a fuel pressure in the fuel rail when the monitored value of the engine speed is less than or equal to a predetermined threshold value thereof.

* * * * *